United States Patent [19]

Ashmus et al.

[11] 4,023,526

[45] May 17, 1977

[54] APPARATUS FOR APPLICATION OF FOAM TO A SUBSTRATE

[75] Inventors: Donald Harold Ashmus; William Wirt Rankin; Andrew Tainter Walter, all of Charleston, W. Va.

[73] Assignee: Union Carbide Corporation, New York, N.Y.

[22] Filed: Mar. 25, 1976

[21] Appl. No.: 670,433

[52] U.S. Cl. ..... 118/410; 156/78; 427/244

[51] Int. Cl.[2] ..... B05C 3/00; B32B 5/18

[58] Field of Search ..... 118/410–415, 118/407; 156/78, 79; 427/244; 425/4 R, 4 C

[56] References Cited

UNITED STATES PATENTS

| | | | |
|---|---|---|---|
| 2,471,330 | 5/1949 | Knight et al. | 118/415 X |
| 3,135,630 | 6/1964 | Bielinski et al. | 118/410 |
| 3,181,199 | 5/1965 | Voelker | 156/78 X |
| 3,235,400 | 2/1966 | Voelker | 118/407 X |
| 3,470,848 | 10/1969 | Dreher | 118/410 |
| 3,521,602 | 7/1970 | Coghill | 118/410 |
| 3,679,476 | 7/1972 | Van Oosterhout et al. | 118/413 X |
| 3,899,999 | 8/1975 | Christ et al. | 118/411 |
| 3,969,780 | 7/1976 | Henderson | 118/410 |

*Primary Examiner*—James Kee Chi
*Attorney, Agent, or Firm*—Francis M. Fazio

[57] ABSTRACT

Foam applicator heads for the application of a functional chemical treating composition in the form of a froth or foam to a substrate, such as a textile or fabric. The apparatus enables the uniform application in foam form of many functional chemicals composition that are to be used for treatment of the substrate in such manner as to leave the treated material essentially dry to the touch when the treating substrate was initially dry to the touch.

10 Claims, 5 Drawing Figures

APPARATUS FOR APPLICATION OF FOAM TO A SUBSTRATE

BACKGROUND OF THE INVENTION

The majority of the processes used in the treatment of fibrous materials, such as textiles and paper, entail immersion of the material in an aqueous bath containing the treating compound. Consequently, the equipment used in such processes includes facilities for the applying the aqueous compositions followed by means for removing the excess water from the treated substrate, such as squeeze rolls, extractors and driers. More recently, processes for applying the treating compositions in the form of a foam have been developed; however, the equipment or apparatus uses to apply the foam leaves much to be desired, as can be seen from the descriptions of U.S. Pat. No. 1,948,568, U.S. Pat. No. 3,697,314 and U.S. Pat. No. 3,762,860. The equipment disclosed in these references requires suspension of the textile in the foam bath, conveying the textile or yarn through the foam, or padding the textile with the foam followed by heating to break the foam.

SUMMARY OF THE INVENTION

This invention is directed to foam applicator heads that enable one to uniformly and evenly apply in foam form a functional chemical textile treating compound to the surface of a substrate. The applicator heads comprise foam distribution chamber means, foam distribution plate means, foam application chamber means, and nozzle means for the application of the foam to the substrate in such manner that a predetermined and controlled amount of the foamed functional treating compound is applied to the substrate.

DESCRIPTION OF THE INVENTION

In the instant invention, a foam applicator head is described and claimed that can be used with conventional foam generating means for the treatment of a substrate, preferably a porous substrate, with a predetermined and controlled amount of a foam. This equipment is more fully described below.

It is to be noted that figures and angles are not drawn to scale and are presented to facilitate discussion and understanding of the claimed invention. It is also to be noted that the figures do not show the means for generating the foam and conducting it to the foam applicator head, the means for conveying the substrate to and across the foam applicator head, or the means for measuring temperature or pressure or other physical constants. Note also that in the discussions the substrate is presumed to be travelling in a right to left direction as indicated by the arrow.

The foam applicator heads of thie invention comprise, in combination, foam distribution chamber means having foam inlet means connected thereto for effecting transfer of foam from foam generating means into said foam distribution chamber means, a foam distribution plate separating said foam distribution chamber means from foam application chamber means, said foam distribution plate having foam distribution holes therethrough to effect movement of foam from said distribution chamber means to said foam application chamber means, said foam application chamber means comprising nozzle lips extending angularly from the plane of said foam distribution plate to define a nozzle orifice, said nozzle orifice effecting application of the foam to a substrate travelling across said nozzle orifice, all of said chamber means enclosed at each end by end wall means.

Figure 1:
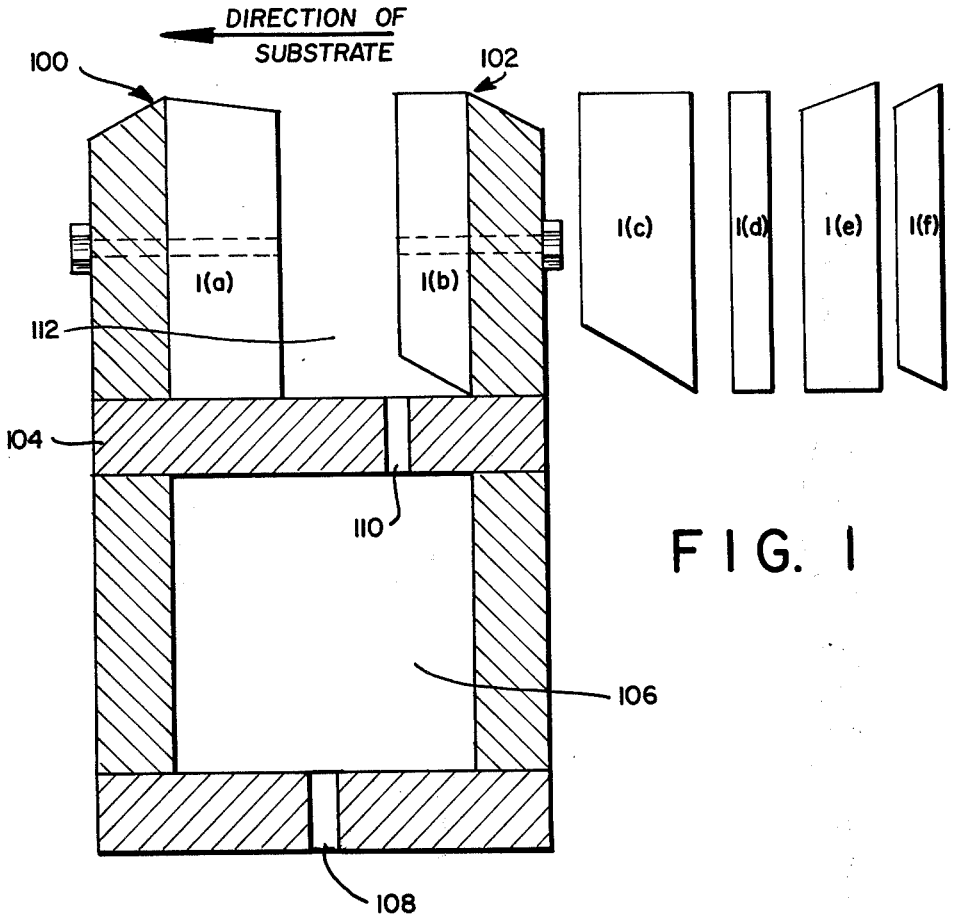
FIG. 1 is a schematic end view illustrative of a foam applicator head in which both exterior longitudinal walls of the foam application chamber are in fixed position.

Referring to FIG. 1 of the drawings there is shown an end view of an embodiment of a foam applicator head in which both exterior longitudinal walls of the foam application chamber are in fixed position and the nozzle orifice width or nozzle slot opening can be adjusted in size by the use of nozzle orifice adjusters. The drawing shows several configuration possible for the nozzle orifice adjusters; these are identified as 1(*a*), 1(*b*), 1(*c*), 1(*d*), 1(*e*) and 1(*f*), with 1(*a*) and 1(*b*) shown bolted in position in the foam application chamber 112. Though the drawing shows the use of nozzle orifice adjusters 1(*a*) and 1(*b*), there may be instances in which one may choose to use only a single nozzle orifice adjuster attached to either the upstream nozzle lip 102 or the downstream nozzle lip 100, or none whatsoever. This is dependent upon the construction of the foam applicator head or the nozzle orifice width desired at any particular time. Use of nozzle orifice adjusters enables broader utility of a single foam applicator head.

The foam applicator head of FIG. 1 shows a foam inlet point 108 in the base thereof. There can be more than one such foam inlet and while the drawing shows its location in the base, it can be located at either end or in the longitudinal side walls thereof feeding into the foam distribution chamber 106. The foam is fed into the foam distribution chamber 106 of the foam applicator head via the foam inlet 108 at a positive pressure. In the foam distribution chamber 106 a pressure equilibrium results as the foam completely fills the foam distribution chamber 106 due to the flow resistance imposed by the distribution plate 104 which separates the foam distribution chamber 106 of the applicator head from the foam application chamber 112. It is to be understood that there can be a multiplicity of foam distribution chambers 106 and foam distribution plates 104 in series with the foam flowing from a lower foam distribution chamber into at least one intermediate foam distribution chamber and finally into the foam application chamber, with foam distribution plates separating each chamber. The number of foam distribution chambers may thus vary from 1 to about 4 or more. However, it is preferred not to have more than 2 and the number is determined by the effects upon the foam, i.e., they should not be so numerous as to cause deterioration of the foam in the foam distribution chambers as it flows from one chamber into another through the foam distribution holes. This foam distribution plate 104 contains a plurality of foam distribution holes 110 that permit the foam to travel from the foam distribution chamber 106 into the foam application chamber 112. The number and sizes of the foam distribution holes 110 will vary depending upon the size of the foam applicator head, the nature of the foam, substrate being treated and the volume rate at which the foam treatment is to be delivered to the substrate. When treating a substrate wider than about 10 inches, uniformity of treatment across the width pf the substrate is improved as the flow resistance imposed by the foam distribution plate 104 is increased. The flow resistance should create a differential pressure between the foam distribution chamber 106 and the foam application chamber 112 of from about 3 to about 150 inches of water pressure. The preferred pressure differential in any particular instance varies and is dependent upon many factors, such as, the size of the foam applicator head, the nozzle orifice width, the number of foam distribution holes 110 in the foam distribution plate 104, the chemical and physical make-up of the foam itself, the substrate being treated, the amount desired to be added to the substrate, the velocity of the substrate over the nozzle lips, etc. However, this can be adjustable by careful preliminary evaluation. Too low a pressure differential will cause non-uniform application of the foam across the width of the substrate. Too high a pressure differential can cause rupture of the foam as it passes through the foam distribution holes 110, or even plugging of said holes. A convenient means for adjustment is the use of plugs or seals to close some of the foam distribution holes while leaving open those desired. As the foam enters the foam application chamber 112 a slight pressure drop can occur and the foam application chamber 112 fills with the foam. The pressure in this chamber is dependent upon many factors including the rate of feed of foam thereto and the rate of uptake of the foam by the substrate travelling across the nozzle orifice. The foam application chamber 112 has a nozzle orifice whose width or slot opening is defined by an upstream nozzle lip 102 and a downstream nozzle lip 100; as previously indicated nozzle orifice adjusters 1(*a*) to 1(*f*) can be employed to adjust the nozzle orifice width. These can be conveniently attached by conventional clamping or bolting means to the fixed exterior chamber walls. In treating the substrate with the foam the substrate travels across the nozzle lips 100 and 102 and in contact with them. The angle that the substrate makes with the nozzle lips will be discussed in detail hereinafter.

Several configurations for the nozzle orifice adjusters are shown by 1(*a*) to 1(*f*) inclusive. The nozzle orifice adjuster is generally installed so that its upper end is parallel to or at the same height as the exterior chamber wall. Its length is the longitudinal length of the foam applicator head. Its width will vary since it is used to adjust the nozzle orifice opening and the angle or angles that the end has to its height or perpendicular plane can vary as will be discussed in detail hereinafter.

The drawing in FIG. 1 shows both the upstream nozzle lip 102 and the downstream nozzle lip 100 comprised of the exterior chamber wall and nozzle orifice adjusters 1(*b*) and 1(*a*) respectively, with the nozzle orifice therefore being the distance or space remaining between 1(*b*) and 1(*a*). In a modification thereof in which the nozzle orifice adjusters are not present, the nozzle orifice would consist of the distance or space between the inside planes of the two fixed exterior walls of the foam application chamber 112. In either instance the angles of the two nozzle lips with the substrates must be taken into consideration. However, they are not shown to scale in the figures.

Figure 2:
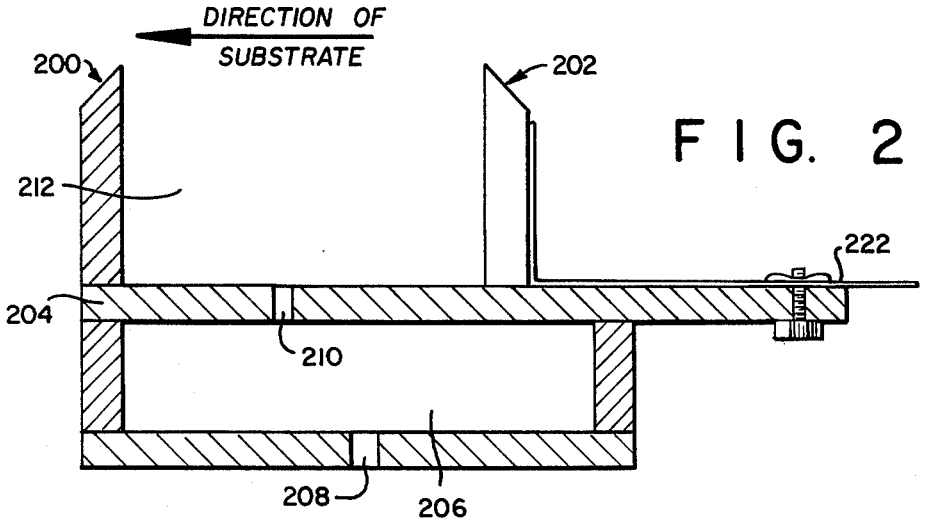
FIG. 2 is a schematic end view illustrative of a foam applicator head in which one exterior longitudinal wall of the foam application chamber is in a fixed position and the position of the other exterior wall is adjustable.

The foam applicator head illustrated by FIG. 2 is one in which one exterior longitudinal wall of the foam applicator chamber 212 is fixed and the other exterior longitudinal wall is movable or adjustable so as to enable adjustment of the nozzle orifice width or slot opening. While the figure portrays the upstream nozzle lip 202 as the movable exterior longitudinal wall, it is to be understood that the downstream nozzle lip 200 or both the upstream 202 and downstream 200 nozzle lips could be movable. In this figure the construction of the foam applicator head is similar to that portrayed in FIG. 1 and consequently the discussion of the various components and chambers in relation to FIG. 1 is equally applicable to their equivalent parts in FIG. 2. The major difference existing between FIG. 2 and FIG. 1 is the movable or adjustable exterior wall structure of FIG. 2 and the presence of the adjustment clamp or other means for holding said wall in the selected position. Not shown in FIG. 2 are the nozzle orifice adjusters 1(*a*) to 1(*f*) that one may, in some instances, choose to use. In some instances the foam applicator head portrayed in FIG. 2 can be advantageously modified by the complete elimination of the upstream nozzle lip 202 and the means 222 for retaining said lip at its selected position. In such instances the foam application chamber 212 essentially comprises the downstream lip 200, the foam distribution plate 204 and the two end seals, with the substrate travelling across and in contact with the downstream nozzle lip 200. The figure shows foam distribution chamber 206, with foam inlet 208, foam distribution plate 204 and foam distribution holes 210.

Figure 3:
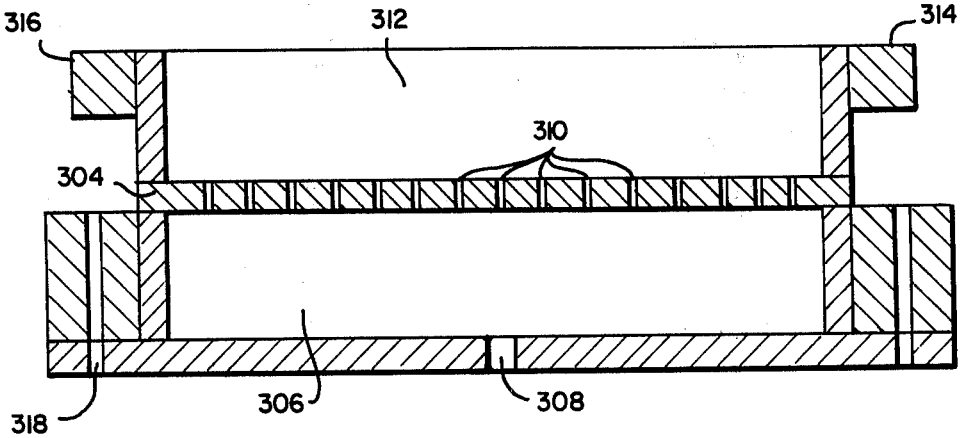
FIG. 3 is a schematic side view illustrative of a foam applicator head.

FIG. 3 represents a longitudinal side view of a foam applicator head taken through the foam inlet 308, whose location is again portrayed in the base thereof. The side view includes the end walls 314 and 316 and suitable mounting means 318. Also shown is a manner in which the foam distribution holes 310 are situate in the foam distribution plate 304. This side view is representative of any foam applicator head portrayed in FIG. 1 or FIG. 2. The foam distribution chamber is 306 and the foam application chamber is 312.

Figure 4:
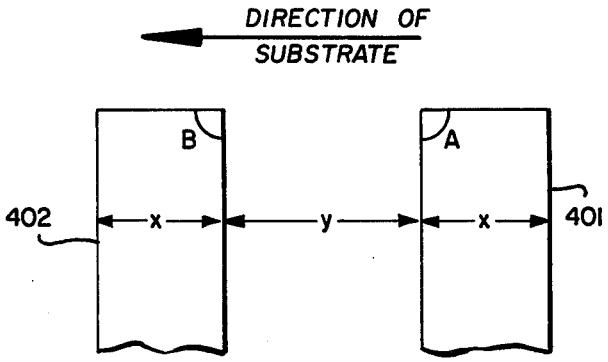
FIG. 4 and FIG. 5 are schematic views showing relative positions of the nozzle lips and the angles thereof, as subsequently discussed in more detail.
Figure 5:
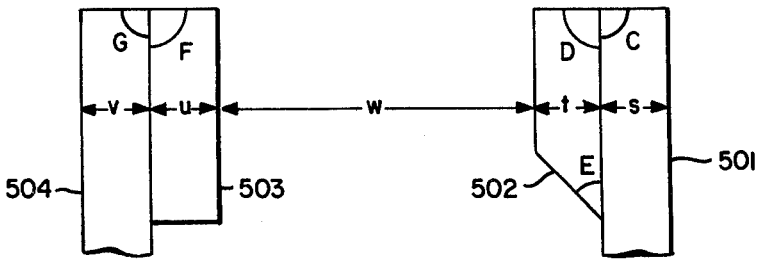

FIG. 4 and FIG. 5 are representative of the relative positions of the upstream nozzle lip and downstream nozzle lip to each other and are presented to facilitate discussion and understanding of the angles of the lips and of the adjusters.

FIG. 4 shows a pair of nozzle lips 401 and 402 without nozzle orifice adjusters attached thereto. In this FIG. 401 represents the upstream nozzle lip and 402 represents the downstream nozzle lip. The width $x$ of the nozzle lip can be any suitable width desired. The distance $y$ between the two nozzle lips, the nozzle orifice, can be from 0.01 to about 6 inches, preferably from 0.25 to 1 inch, most preferably from 0.5 to 0.75 inch. Angle A can vary from about 15° to about 90°, preferably from about 45° to about 90° and angle B can be from about 15° to about 135°, preferably from about 60° to about 110°, most preferably about 95°. It is to be noted that angles A and B can be but need not be equal.

FIG. 5 shows a pair of nozzle lips with nozzle orifice adjusters attached thereto. The entire unit 501 and 502 represents the upstream nozzle lip wherein 502 is the nozzle orifice adjuster. The entire unit 503 and 504 represents the downstream nozzle lip wherein 503 is the nozzle orifice adjuster. Components 502 and 503 would be the equivalents of 1(*a*) to 1(*f*) inclusive of FIG. 1. The distance w between the two nozzle lips, the nozzle orifice, can be from 0.1 to about 6 inches, preferably from 0.25 to 1 inch, most preferably from 0.5 to 0.75 inch. The widths of s and v can be from 0.25 to 1 inch; the width of *t* can be from 0.1 to 4 inches, and the width of u can be from 0.5 to 1.5 inches. Angle C can be from about 30° to 90°, preferably about 45°; angle D can be from 75° to 90°, preferably about 90°; angle E can be from 30° to 90°; angle F can be from 75° to 90°, preferably from 80° to 88°, most preferably 85°; and angle G can be from 45° to 105°, preferably from 45° to 100°.

In FIG. 5 the upstream nozzle lip 501 plus 502 construction illustrated is that in which a nozzle orifice adjuster, 502, has been attached to the exterior wall, 501, of the foam applicator head. It is apparent that a similar construction can be fabricated from a single piece wherein the angles C, D and E are as hereinbefore defined. The same can be accomplished for the downstream nozzle lip 503 plus 504.

In a typical operation, a liquid formulation is prepared containing the functional chemical treating agent, frothing agent, wetting agent if desired, and water. This formulation is frothed to a foam in conventional commercially available foaming means and conveyed to the foam applicator head via suitable conduit means. The foam enters the foam distribution chamber via the foam inlet wherein a pressure equilibrium results as the foam completely fills this chamber. Not shown in the drawings are means for recycling foam and condensate and means for measuring pressure at any point in the foam applicator head. As the foam distribution chamber fills, the foam passes through the foam distribution plate into the foam application chamber, rises and comes into contact with the substrate which is travelling across the nozzle orifice and which is in contact with the nozzle lip.

The angle of contact that the substrate makes with the inward taper of the downstream nozzle lip has an effect on the uniformity of application and the pressure drop observed across the fabric in the foam application chamber. It was observed that use of a foam applicator head of the type shown in FIG. 1 having a foam distribution chamber that measured 2 inches wide, 2 inches high and 9 inches long and a foam application chamber that measured the same but contained an adjuster 1(*a*) that was 0.75 inch wide and tapered inwardly 5° resulting in a nozzle orifice opening about 1 3/16 inch, exhibited the lowest pressure drop across the fabric, in inches of water; whereas, the same foam applicator head in which the taper varied above and below this angle showed a higher pressure drop across the fabric. In all instances, however, uniformity, as evidenced by a tracer dye, of the wash-wear treatment was good to excellent. The foam was applied to 65/35/polyester/-cotton at a fabric speed of 300 feet per minute and at an add-on of 6 weight percent. The foam comprised a wash-wear formulation containing 1,3-dimethylol-4,5-dihydroxy-2-imidazolidone and had a foam density of 0.037 g/cc. The results are shown below:

| Degree of Taper | Pressure Drop |
|---|---|
| 0 | 5.5 |
| 2 | 5 |
| 5 | 4 |
| 10 | 5 |
| 15 | 5.25 |

-continued

| Degree of Taper | Pressure Drop |
|---|---|
| 20 | 7 |

The apparatus of this invention can be used to treat any porous substrate such as a textile fabric or a non-woven material, paper, leather or wood veneer, with any of the functional chemicals that are normally used in their treatment. Thus, the apparatus can be used to apply a flame retarding composition, a waterproofing or water repellant composition, a latex, a fabric softener, a lubricant, a hand builder, a dye or pigment for coloring the fabric, a sizing agent, a whitening agent or fluorescent brightener, a bleach, a binder for a non-woven fabric, a scouring agent, a radiation curable or polymerizable monomer or polymer or oligomer, or any other material that is normally used or applied to a fabric or similar substrate. As previously indicated, use of the apparatus of this invention permits one to apply the functional or treating chemical in the form of a froth or foam to the surface of the material without employing unnecessarily large quantities of water. In view of the escalating energy costs and shorts supplies of natural gas and other fuels this is a distinct advantage since less energy is required to dry the fabric for further and subsequent treatment of the foam treated substrate.

In the use of the foam applicator head of this invention a functional treating formulation or composition containing the functional reagent that is to be added to the fabric is foamed in a foaming apparatus. The term functional treating composition or variants thereof is used in this application to define a formulated composition containing a reactive or functional reagent that is used to treat a porous substrate such as a fabric or paper to impart a desired physical or chemical property thereto. These functional treating compositions are used to produce the foams applied to the substrate with the foam applicator head of this invention and contain the foaming agent, functional chemical, wetting agent, water and other additives, as identified and in the concentrations hereinafter set forth. The equipment used for producing a foam is well known and many different types are commercially available. The composition, in the form of a foam, is then conveyed to the foam applicator head where it is transferred to the surface of the textile material that is to be treated. The manner in which the foam is transferred to the textile material is critical for uniform distribution on to the fabric. It has been found that the manner in which the transfer is made, the specific density and bubble size, and the stability of the foam are also important.

The foam is usually generated in commercially available foam generating devices, which generally consist of a mechanical agitator capable of mixing metered quantities of a gas, such as air, and a liquid chemical composition containing the functional treating agent or chemical that is to be applied to the fabric and converting the mixture to a foam. It has been found that the density of the foam, its average bubble size and the stability or foam half-life of the foam are important factors. The foam density can range from 0.005 to 0.3 gram per cc, preferably from 0.01 to 0.2 gram per cc.

The foams generally have an average bubble size of from about 0.05 to 0.5 millimeters in diameter and preferably from 0.08 to 0.45 millimeters in diameter.

The foam half-life is from 1 to 60 minutes, preferably from 3 to 40 minutes.

The foam density and foam half-life are determined by placing a specified volume of the foam in a laboratory graduated cylinder of known weight, a 100 cc or 1,000 cc cylinder can be used, determining the weight of the foam in the cylinder, and calculating the density from the volume and weight of the foam in the cylinder.

From the measured foam density and volume, and the known density of the precursor liquor, the liquor volume which would equal one-half of the total weight of the foam in the cylinder is calculated. The foam halflife is the time for this volume of liquid to collect in the bottom of the cylinder.

The foam bubble size is measured on a sample of foam taken at the applicator nozzle and is determined by coating the underside of a microscope glass slide with the foam, placing the slide on the microscope, supporting the slide on each end by two slides, and photographing it at once, preferably within 10 seconds, with a Polaroid camera at a magnification of 32 fold. In an area of the photomicrograph measuring 73 by 95 mm, corresponding to an actual slide area of 6.77 square millimeters, the number of bubbles is counted. The average bubble diameter size in mm. is then determined by the equation:

$$\text{Average Bubble Size} = \sqrt[2]{\frac{}{\pi}}\left[\frac{(6.77)(\text{Liquid Density} - \text{Foam Density}}{\text{No. of Bubbles}}\right]^{1/2}$$

The formulated compositions used for producing the foam contain a frothing or foaming agent at a concentration of about 0.2 to 5 weight percent, preferably from 0.4 to 2 weight percent; the functional chemical at a concentration of from about 5 to 75 weight percent, preferably from 10 to 60 weight percent, this being dependent upon the particular functional chemical being employed, with water making up the balance of the weight of the total composition. There can also be present, as an optional ingredient, a wetting agent at a concentration of from about 0.001 to 5 weight percent or more, preferably from about 0.01 to 1.0 weight percent of the total composition when the wetting agent is used. However, it need not always be present and can in some instances be completely absent when the foaming agent supplies sufficient wetting action.

As a frothing agent, one can use any surface active agent which will produce a foam having the characteristics herein before described. The composition is foamed in a conventional foaming apparatus to produce a foam using air or any inert gaseous material. The amount of gas that is used to foam the composition is generally about 5 times the volume of the liquid composition that is to be formed and can be as much as 200 times or more thereof. In this manner there is produced a foam having the desired density and bubble size. The particular components used to produce the foam are important in order to achieve a foam which will be readily absorbed in a uniform manner by the substrate material and permit the application of the desired amount of the functional chemical to the substrate.

Illustrative of suitable foaming agents, one can mention the ethylene oxide adducts of the mixed $C_{11}$ to $C_{15}$ linear secondary alcohols which contain from about 10 to 50 ethyleneoxy units, preferably from about 12 to 20 ethyleneoxy units in the molecule. One can also use the ethylene oxide adducts of the linear primary alcohols having from 10 to 16 carbon atoms in the alcohol moiety, or of the alkyl phenols wherein the alkyl group has from 8 to 12 carbon atoms, wherein the adducts can have from about 10 to about 50, preferably from about 12 to 20 ethyleneoxy units in the molecule. Also useful are the fatty acid alkanolamides such as coconut fatty acid monoethanolamide. Another suitable class of frothing agents is the group of sulfosuccinate ester salts, such as disodium N-octadecylsulfosuccinate, tetrasodium N-(1,2-dicarboxyethyl)-N-octadecylsulfosuccinate, diamyl ester of sodium sulfosuccinic acid, dihexyl ester of sodium sulfosuccinic acid, dioctyl ester of sodium sulfosuccinic acid, and the like. In addition to the above, nonionic and anionic surfactants one can also use a cationic surfactant or an amphoteric surfactant such as distearyl pyridinium chloride, N-coco-beta-aminopropionic acid (the N-tallow or N-lauryl derivatives) or the sodium salts thereof, stearyl dimethyl benzyl ammonium chloride, the betaines or tertiary alkylamines quarternized with benzene sulfonic acid. These are well known and any similar surfactant can be used in addition to those specifically identified above. Blends of one or more surfactants are often used to advantage. In selecting the foaming agent for a particular formulation, care must be exercised to use those which will not unduly react with the other reactants present or interfere with the foaming or treating process.

As previously indicated a wetting agent also can be optionally present when its presence is needed to produce a foam of the desired fast breaking and wetting properties with sufficient stability to be pumped from the foam generator to the applicator nozzle. The foams are semi-stable and fast wetting and are produced from compositions containing the defined components in relatively high concentration when compared to aqueous treating compositions heretofore used. The stability of the foam produced with these compositions must allow pumping of the foam from the foam generator to the applicator head, but the foam must be readily broken and rapidly absorbed when it reaches the substrate surface. The foam breakdown characteristic is important, since retention of the foam or bubble structure on the treated substrate surface can result in craters, spotting, or otherwise uneven distribution on the substrate. In addition, foam breakdown characteristics are important to facilitate recycle; any of the known physical techniques, i.e. elevated temperature, mechanical shear, etc,, can be used in the recycle step. In regard to foam breakdown, the foams having the half-life defined have been found to possess the desired combination of stability to facilitate pumping and delivery to the substrate, and instability to facilitate fast wetting when contacted with the substrate and ease of recycle.

The presence of the optional wetting agent is important when the foaming agent used produces a stable foam but is a relatively poor wetting agent with the consequence that the foam does not provide sufficient front to back uniformity or penetrability for continuous high speed application to the substrate. In such instances a combination of foaming agent and wetting agent is used and illustrative of suitable wetting agents one can mention the adduct of 6 moles of ethylene oxide with trimethyl nonanol, the adducts of about 7 or 9 moles of ethylene oxide with the mixed $C_{11}$ to $C_{15}$ linear secondary alcohols or with the $C_{10}$ to $C_{16}$ primary alcohols, the adduct of 9 moles of ethylene oxide with nonylphenol; the silicone wetting agents of the structure

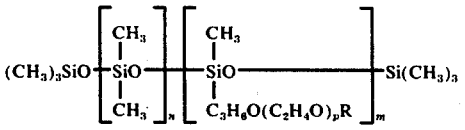

wherein $n$ has a value of 5 to 25, $m$ has a value of 3 to 10, $p$ has a value of 6 to 20 and R is alkyl of 1 to 6 carbon atoms; also useful are the commercially available fluorocarbon wetting agents such as the known perfluoroalkylated surfactants.

The amount of such wetting agent to be added to provide for the fast breaking and rapid absorption properties will vary depending upon the particular wetting agent selected, however, this amount can be readily ascertained by a preliminary small scale evaluation. Thus, it was observed that the concentration of the fluorocarbon wetting agents is preferably in the range of from 0.001 to 0.5 weight percent, and the range for the silicone wetting agents is preferably from 0.01 to 0.3 weight percent. It has also been observed that excessive quantities of the silicon or fluorocarbon wetting agents may inhibit foam formation or shorten foam stability to such an extent that pumping and delivery of foam to the substrate is no longer feasible. Thus, a preliminary small scale screening test will establish if such a problem exists in any particular instance. As previously indicated, some foaming agents possess sufficient wetting properties that there is no need for the use of the supplementary or optional wetting agents. However, in most instances, better front to back uniformity of treatment of the substrate is obtained using a mixture or combination of foaming agent and wetting agent. It has also been observed that the addition of a known foam stabilizer, such as hydroxyethyl cellulose or hydrolyzed guar gum, can be of benefit, provided it does not unduly affect the desired foam properties.

The foam applicator head of this invention can be used to apply any number of functional or treating chemicals to a substrate to impart a particular property or treatment thereto. Thus, it can be used to apply flame-retarding reagents, waterproofing or water-repellant reagents, mildew proofing reagents, bacteriostats, antistats, permanent press or wash and wear compositions, softeners, lubricants, hand builders, dyes, pigments, sizes, whitening agents, fluorescent brighteners, bleaches, binders for non-woven fabrics, latexes, scouring agents, thermal or radiation curable monomers or oligomers or polymers, soil or stain release agents, or any other material known to be used in the treatment of textiles or papers. Illustrative of typical functional chemicals one can mention dimethyloldihydroxyethylene urea, dimethylolethylene urea, dimethylolpropylene urea, urea formaldehyde resins, dimethylol urons, the methylolated melamines, methylolated triazones; the methylolated carbamates such as the ethyl or methoxyethyl or isopropyl or butyl carbamates; the epoxides such as vinyl cyclohexene dioxide, 2,3-diallyoxy-1,4-dioxane, 2,3-bis(2,3-epoxypropoxy)-1,4-dioxane, the diglycidyl ether of bisphenol-A, bis(3,4-epoxybutyl)ether; flame-proofing agents such as tetrakis hydroxymethyl phosphonium chloride, polyvinyl chloride latexes, (N-hydroxymethyl-3-dimethyl phospono)propionamide; water-proofing or water repellant agents such as aluminum formate, sodium formoacetate, methylene bis-stearamide, mildew proofing and bacteriostat agents such as copper-8-quinolinolate, dihydroxydichlorodiphenylmethane, zinc salts of dimethyldithiocarbamic acid, dihydroxymethyl undecylenamide; latexes such as polyvinyl acetate latexes, acrylic latexes, styrene-butadiene latexes; softeners such as emulsifiable polyethylene, dimethyl stearate ammonium salts; lubricants such as butyl stearate, diethylene glycol stearate, polyethylene glycol, polypropylene glycol; hand buiilders such as polyvinyl acetate latexes, acrylic latexes, styrenebutadiene latexes; dyes and pigments such as Acid Blue 25 (Color Index 62055), Acid Red 151 (Color Index 26900), Direct Red 39 (Color Index 23630), Dispersed Red 4 (Color Index 40755), Phthalocyanine Blue 15 (Color Index 74160); sizes such as polyvinyl alcohol, corn starch; whitening agents such as 4-methyl-7-dethylaminocoumarine; bleaches such as sodium hypochlorite, chlorine, hydrogen peroxide. dichlorodimethyl hydantoin, sodium perborate; binders for non-woven fabrics such as ethylene-vinyl acetate emulsion polymer, acrylic emulsion polymer, vinyl-acrylic copolymer; scouring agents such as sodium lauryl sulfate, triethanolamine lauryl sulfate, sodium N-methyl-N-oleoyltaurate, primary and secondary alcohol ethoxylates; radiation curable monomers and oligomers such as 2-hydroxyethyl acrylate, neopentyl glycol diacrylate, pentaerythritol triacrylate, isodecyl acrylate, acrylated epoxidized soybean or linseed oil; antistatic agents such as ethoxylated stearyl amines; soil or stain release agents such as acrylic polymers and fluorocarbon emulsions.

The foam compositions applied with the foam applicator head of this invention are prepared by mixing the selected functional chemical, foaming agent, wetting agent and water, with other conventional agents normally present, in the amounts indicated. This formulation has a Brookfied viscosity of from 0.5 to 75 cps, preferably from 1 to 50 cps at 25° C. The manner of preparing the formulation will depend upon the particular functional or treating agent present and the procedures normally used for preparing compositions containing the selected functional agent are normally employed in producing our formulations. The formulation is then foamed, the foam is conveyed to the foam applicator head and applied to the surface of the substrate.

In producing the foam, a metered quantity of the formulation is introduced to the foamer and foamed. The foaming step is controlled by adjusting the volume of air introduced to the foamer and the rotation rate. in rpm, of the rotor in the foamer. The rotor's rotation rate plays an important role in producing a foam that will have the previously defined bubble size and half-life. The relative rates of feed of the formulation and the gas will determine the density of the foam. These facts are known to those skilled in the art.

It has been found that when the width or gap of the nozzle orifice is of a dimension such that the machine contact time is equal to or less than the equilibrium contact time for the particular foam-substrate combination that is being run, as defined by the equation MCT ECT, good application is achieved.

The machine contact time, abbreviated MCT, is the amount of time that any given point of the substrate remains over the nozzle orifice during the application of foam to the substrate. The machine contact time in seconds is equal to the gap or orifice width in inches divided by the speed of the fabric in inches per second. The equilibrium contact time, abbreviated ECT, is the time required for the substrate to absorb the foam at the rate the foam is being delivered to the applicator nozzle. Additional foam will be absorbed by the substrate when the foam is under pressure. Preferably, a slight uniform pressure of 2 to 20 inches of water is maintained to control uniformity of application. It has been observed that when MCT is greater than ECT that nonuniform application results. In other words, when absorption rate is greater than the delivery rate of the foam, uniform application is no longer achieved. However, in some instances it may be desired to have MCT greater than ECT when applying the foam to the substrate. It has been observed that in such instances one may obtain an uneven stripe or random pattern across the width of the substrate. This is of interest, for example, when even dyeing is not desired and a barre or stripe is sought.

The following equations are useful in determining the amounts of formulated composition metered into the foamer and the amount of foam to be applied to the substrate. Equation I indicates the amount of liquid formulated composition metered in cubic feet per minute:

$$V_1 = \frac{(C_s)(v_s)(w_s)(\lambda)}{c_1\rho_1} \qquad \text{I}$$

Equation II indicates the amount of foam applied to the substrate in cubic feet per minute:

$$V_f = \frac{(C_s)(v_s)(w_s)(\lambda)}{(c_1)(\rho_f)} \qquad \text{II}$$

The symbols have the following meanings:

$v_s$ = substrate linear velocity (line speed), ft/min
$V_1$ = liquor volume flow rate, $ft^3$/min
$V_f$ = foam volume flow rate, $ft^3$/min
$\rho_f$ = density of foam, lb/$ft^3$
$c_1$ = concentration (solids) of liquor, % ows
$w_s$ = fabric substrate weight, lb/$ft^2$
$c_s$ = solids add-on to fabric, % owf
$\lambda$ = width across treated substrate or nozzle orifice, ft
$\rho_1$ = density of liquid, lb/$ft^3$ The test procedures used were:

| | |
|---|---|
| Durable press rating | AATCC 124-1967T; Washing Procedure III (140° F); Drying Procedure A & B (Tumble and Line Dry) |
| Dry Wrinkle recovery | AATCC 66-1959T |
| Tear strength (Elmendorf) | ASTM D-1424-59 |
| Tensile strength (Grab) | ASTM D-1862 |
| Wash-wear | AATCC 124-1967T Washing Procedure III; Drying Procedure A and B |
| Yellowness Index | Using a Hunterlab Model D-40 Reflectormeter |

$$\text{Yellowness} = \frac{\text{Green reflectance} - \text{Blue reflectance}}{100}$$

The following definitions apply to various components used in the examples:

DMDHEU — 1,3-dimethylol-4,5-dihydroxy-2-imidazolidone, 45% aqueous solution.

Softener I — a 30 weight percent aqueous emulsion of low density, low molecular weight modified polyethylene.

Wetting Agent I — adduct of mixed $C_{11}$ to $C_{15}$ linear secondary alcohols with 9 moles of ethylene oxide.

Wetting Agent II — siloxane of the average structure:

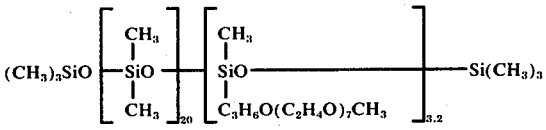

Wetting Agent IV — adduct of mixed $C_{11}$ to $C_{15}$ linear secondary alcohols with 12 moles of ethylene oxide.

EXAMPLE 1

A formulation was prepared by mixing the following components at the weight percentage amounts indicated:

| | |
|---|---|
| DMDHEU | 81.2 |
| Zinc nitrate, 30% | 17.9 |
| Frothing Agent I | 0.3 |
| Wetting Agent IV | 0.6 |

The formulation also contained a trace amount of a red acid dye sufficient to tint the composition so that visual examination of uniformity of application could be determined.

The formulation was foamed in an Ease-E-Foamer Model No. E1000 foamer at a rotor speed of 410 rpms using a sufficient volume of air to produce a foam having a density of 0.078 g/cc. The liquid formulation was fed to the foamer at a rate of 564 cc per minute and the pressure on the foamer head was 16 psig. The foam was conveyed to an applicator nozzle and uniformly applied to one surface of a 50/50 polyester/cotton sheeting about 9 inches wide that weighed about 8 ounces per square yard. The fabric was travelling over the applicator nozzle at a speed of 300 feet per minute and the add-on of foam formulation to the fabric was 4.5 weight percent. The foam was evenly and uniformly applied to the fabric and as the foam composition contacted the fabric the bubbles burst, the composition was absorbed by the fabric and the fabric was immediately essentially dry to the touch. The treated fabric was then cured at 340° F. for 3 minutes; it had a dry wrinkle recovery of 292° and a tear strength of 2,997 grams, these properties on the untreated fabric were 215° and 3,541 grams, respectively.

The equipment used in producing and applying the foam were the identified foamer; suitable feed, take-up and guide roll means for the fabric; means for delivering the foam from the foamer to the foam applicator head; and the foam applicator head. The foam applicator head consisted of a lower foam distribution chamber with a foam applicator chamber and nozzle mounted thereto above a foam distribution plate. The internal dimensions of the lower foam distribution chamber were a length of 9 inches, a width of 2 inches and a height of 2 inches. The base of this lower foam distribution chamber had a 0.75 inch diameter foam inlet, centrally located. Above this chamber was a foam distribution plate having a row of 15 foam distribution holes each 3/16 of an inch in diameter. Above the distribution plate was the foam applicator chamber which extended the full 9 inch length of the foam applicator head, had a height of 2 inches above the foam distribution plate and a nozzle orifice slit width of 1 3/16 inches between the two nozzle lips thereof. The space between the lips is the foam application chamber. The upstream nozzle lip was 0.5 inch wide and had an outward taper of 45°. The downstream nozzle lip was 1.25 inches wide with the exterior wall 0.5 inch wide and tapering outward at an angle of 45° and the interior orifice adjuster 0.75 inch wide tapering inward towards the orifice at an angle of 5°. In operation the foam was produced in the foamer, entered the lower foam distribution chamber via the foam inlet in the base thereof, passed through the holes of the distribution plate into the foam application chamber and was applied to the fabric at the orifice of the applicator nozzle. The fabric was drawn across the nozzle lips of the foam applicator head initially contacting the upstream lip and then contacting the downstream lip thereof at the indicated speed. As it moved across the nozzle orifice and the nozzle lips the foam was applied to the surface of the fabric at a slight positive pressure. It was uniformly absorbed by the cotton fibers as established by X-ray emission studies and scanning electron microscopic examination of the treated and cured fabric.

EXAMPLE 2

A formulation was prepared containing the following components in weight percentages:

| | |
|---|---|
| DMDHEU | 81.2% |
| Zinc Nitrate, 30% | 17.9% |
| Wetting Agent IV | 0.6% |
| Foaming Agent I | 0.3% |

The liquid formulation had a density of 1.18 g/ cc. and a total solids of 43.5 weight percent. Foams were produced using a commercially available Ease-E-Foamer operating at 410 rpm at ratios of 10, 13 and 20 volumes of air per volume of liquid. Using the foam applicator heads of this invention the foams were applied to the surfaces of three different fabrics, a 65/35 polyester/cotton (Fabric A), a 50/50 polyester/cotton (Fabric B) and a 100 percent cotton (Fabric C) at an add-on of 6 weight percent. In this series the rate at which the fabric was travelling was varied at 100, 200 and 300 feet per minute over the nozzle orifice to determine the balance point between ECT and MCT at wide orifice openings. The nozzle orifice width was varied by the use of nozzle orifice adjusters to widths of 1 inch, 3 inches, and 4 inches. At these nozzle orifice widths, it was found that good application was obtained under the specified operating conditions. It was also observed that the foam begins to roll in the applicator nozzle and develops a rolling bank at high speeds and wide nozzle openings, as well as a change in the foam structure.

The foam applicator head used in this example were constructed so that the width of the nozzle orifice could be varied over a wide range. The basic structure was similar to that described in FIG. 2 in that it consisted of a foam inlet and a foam distribution chamber, a foam application chamber separated by the foam distribution plate at a height of 1 inch above the base. Applicator Head A had a foam distribution chamber measuring 9 inches long by 1 inch in height by 3 inches in width and a foam application chamber measuring 9 inches long by 3 inches in height with the nozzle orifice width adjustable to from 0.25 inch to 3 inches. The foam distribution plate had 17 holes, each ⅜ inch in diameter. In Application Head B the foam distribution chamber was 6 inches wide and the foam application chamber could be adjusted to a nozzle orifice up to 6 inches in width; this foam applicatior head had the same number and size of foam distribution holes. The nozzle orifice width was equal to the selected adjusted width of the application chamber and selection was made by adjusting the location of one of the nozzle lips, the two nozzle lips forming two longitudinal sides of the foam application chamber. Applicator Head B was used when the orifice width was greater than 3 inches. During application of the foam to the fabric, the fabric was in contact with both the upstream and downstream nozzle lips of the foam applicator head. The conditions under which the fabrics were treated are summarized in the following table wherein the nozzle orifice slit width (in inches) and water pressure (shown in parenthesis, in inches of water) are reported in the following table:

| Fabric | At 100 fpm | | At 200 fpm | | At 300 fpm | | Foam Density g/cc |
|---|---|---|---|---|---|---|---|
| A | ¼ | (—) | ¼ | (¼) | 3 | (¼) | 0.12 |
| B | ¼ | (¾) | ½ | (1) | 3 | (⅝) | 0.12 |
| C | ½ | (2) | ¼ | (1) | 3 | (1½) | 0.12 |
| A | ¼ | (1) | ¼ | (2¼) | 3¼ | (1½) | 0.09 |
| B | ½ | (¾) | ½ | (1½) | 3½ | (1⅜) | 0.09 |
| C | ¾ | (2) | ¾ | (1⅝) | 3¼ | (1¾) | 0.09 |
| A | ½ | (1½) | 1½ | (1½) | 4 | (⅝) | 0.06 |
| B | ¾ | (⅝) | 1½ | (1¼) | 4 | (1) | 0.06 |
| C | 1 | (2) | 1½ | (1½) | 4 | (¼) | 0.06 |

EXAMPLE 3

A series of formulations was prepared differing in the amount of thickener added. The constant components in the formulations were as follows:

| | |
|---|---|
| DMDHEU | 81.2 |
| Zinc Nitrate, 30% | 17.9 |
| Wetting Agent IV | 0.6 |
| Frothing Agent I | 0.3 |

Formulation A did not contain any thickener and had a Brookfield viscosity of 5.2 cps at 23° C. Formulation B contained 0.1 percent hydroxyethyl cellulose (which in a one percent solution had a LVT Brookfield viscosity of about 3,000 cps at 25° C, using a No. 3 spindle at 30 rpm) and had a Brookfield viscosity of 15.7 cps at 23° C. Formulation C contained 0.2 percent of the same hydroxyethyl cellulose and had a Brookfield viscosity of 30.4 cps at 23° C. Formulation D contained 0.3 percent of the same hydroxyethyl cellulose and had a Brookfield viscosity of 83.1 cps at 23° C. These formulations were foamed in a manner similar to that described in Example 1 to produce foams having a density of 0.045 g/cc. and the foams were applied to 4 ounce 65/35 polyester/cotton and 100 percent cotton sheeting fabrics. The foam applicator head used was similar to that described in FIG. 1. It had a foam distribution chamber measuring 9 by 2 by 2 inches and a foam application chamber measuring 9 by 2 by 0.75 inches.

The nozzle orifice was therefore 0.75 inch wide. The foam distribution plate had 15 holes, each 3/16 inch in diameter. The inward taper on the adjuster on the downstream nozzle lip was 5°. The add-on at a fabric speed of 300 feet per minute was six weight percent. The uniformity of application was good for formulations A to C inclusive and fair for formulation D.

EXAMPLE 4

A formulation was prepared containing the following components:

| | |
|---|---|
| DMDHEU | 81.2 |
| Zinc Nitrate, 30% | 17.9 |
| Wetting Agent IV | 0.6 |
| Frothing Agent I | 0.3 |

The liquid formulation had a density of 1.18 g/cc and a total solids content of 43.5 weight percent. Foam was produced using the Ease-E-Foamer by feeding 188 cc per minute of the formulation into foamer with sufficient air to produce a foam that had a density of 0.02 g/cc while operating the foamer at 410 rpm. The foam was applied to the surface of a 50/50 polyester/cotton sheeting fabric at an add-on of 3 percent using the foam applicator head described in Example 3 at a nozzle orifice width of 1 3/16 inches and a 5° inward taper on the downstream nozzle lip. Application to the fabric was at a fabric speed of 300 feet per minute and a pressure drop of 0.25 inch water pressure across the fabric. Good uniform application was achieved.

EXAMPLE 5

A formulation was prepared containing the following components:

| | |
|---|---|
| DMDHEU | 81.2 |
| Zinc Nitrate, 30% | 17.9 |
| Wetting Agent IV | 0.6 |
| Frothing Agent 1 | 0.3 |

This formulation was foamed in an Ease-E-Foamer with the rotor operating at 410 rpm using a formulation feed of 564 cc per minute and a ratio of about 15 volumes of air per volume of formulation. The foam produced had a density of 0.078 g/cc. This foam was applied to an 8 ounces per square yard, 50/50 polyester/cotton fabric sheeting at a fabric speed of 300 feet per minute at an add-on rate of 4.5 percent under the same conditions and using the foam applicator head described in Example 4 at a nozzle orifice opening of 1 3/16 inches. Excellent uniformity was observed. The pressure drop across the fabric was 2 ⅞ inches of water.

EXAMPLE 6

A dye formulation was prepared containing the following:

| | |
|---|---|
| Latyl Orange 2 GFS (C.I. 44) | 6.8 lb. |
| Water | 36.4 lb. |
| Wetting Agent IV | 0.4 lb. |
| Frothing Agent III | 0.4 lb. |

The pH was adjusted to 5–6 with acetic acid and foams were produced having different foam densities using the Ease-E-Foamer with the rotor operating at 340 rpm.

| Foam | A | B |
|---|---|---|
| Density, g/cc. | 0.03 | 0.057 |
| Half-life, min. | — | 5 |
| Liquid feed to foamer, c/c min | 125 | 125 |

The foams were applied to 100 percent polyester and to 65/35 polyester/cotton sheeting fabric using the foam applicator head described in Example 3 with the nozzle orifice adjusted to a gap width between the upstream and downstream nozzle lips of 0.5 inch. The fabric was moving at a speed of 100 feet per minute across the nozzle orifice, contacting both lips of the foam applicator head, total wet add-on was 14 weight percent.

When applying Foam A to the 100 percent polyester, sections of the nozzle orifice were blocked with tape and a striped pattern was obtained on the fabric. The foam, as in the other examples, was uniformly applied to the fabric, leaving the fabric essentially dry to the touch. After standing for a period of time, the striped fabric was heated at 420° F. for 3 minutes to fix the dye. Clear definition of the pattern was obtained. In a similar manner, the entire fabric surface was dyes by removing the tape from the nozzle.

Foam A was used to apply a pattern to 65/35 polyester/cotton with the same foam applicator head. A pattern effect was attained by positioning a stencil between the orifice nozzle and fabric, the stencil moving at the same rate as the fabric, as the foam exited from the orifice nozzle. The dyed areas of the fabric were uniform and even, and clear definition of the dyed areas was noted.

Foam B was applied to 100 percent polyester in the same manner to completely dye the fabric. Uniform application and even dyeing were observed. A section of the fabric was sprinkled with water after the foam was applied, the fabric taken up on a roll, stored about 48 hours, and the dye was then fixed at about 420° F. for 3 minutes, a random pattern was observed showing lighter areas where the water droplets were deposited. In all instances a scour after dye fixation is recommended.

What is claimed is:

1. A foam application head comprising, in combination, foam distribution means having foam inlet means connected thereto for effecting transfer of foam from foam generating means into said foam distribution chamber means, foam distribution plate means separating said foam distribution chamber means from foam application chamber means said foam distribution plate means having foam distribution holes therethrough to effect movement of foam from said foam distribution chamber means to said foam application chamber means, said foam distribution holes being sufficient in amount and size to create a differential pressure of from 3 to 150 inches of water pressure between said foam distribution chamber and said foam application chamber said foam application chamber means comprising nozzle lips extending angularly from the plane of said foam distribution plate to define a nozzle orifice, said nozzle orifice effecting application of the foam to a substrate travelling across said nozzle orifice, all of said chamber means enclosed at each end by end wall means.

2. A foam applicator head as claimed in claim 1, wherein both exterior longitudinal walls of the foam application chamber means are fixed and nozzle orifice adjusters are positioned in said chamber means to effect adjustment of the nozzle orifice width.

3. A foam applicator head as claimed in claim 1, wherein one exterior longitudinal wall of the foam application chamber means is fixed and the second exterior longitudinal wall is movable so as to effect adjustment of the nozzle orifice width.

4. A foam applicator head as claimed in claim 1, wherein both exterior longitudinal walls of the foam application chamber means are movable so as to effect adjustment of the nozzle orifice width.

5. A foam applicator head as claimed in claim 1, wherein the inward taper angle of the downstream nozzle lip is from 75° to 90°, 6. A foam applicator head as claimed in claim 1, wherein the inward taper angle of the downstream nozzle lip is from 80° to 88°.

7. A foam applicator head as claimed in claim 1, wherein the inward taper angle of the downstream nozzle lip is 85°.

8. A foam applicator head as claimed in claim 1, wherein the nozzle orifice width is from 0.1 inch to 6 inches.

9. A foam applicator head as claimed in claim 1, wherein the nozzle orifice width is from 0.5 to 0.75 inch.

10. A foam applicator head as claimed in claim 1, wherein a multiplicity of foam distribution chambers are present in series.

* * * * *

UNITED STATES PATENT OFFICE

CERTIFICATE OF CORRECTION

Patent No. 4,023,526 Dated May 17, 1977

Inventor(s) D. W. Ashmus et al

It is certified that error appears in the above-identified patent and that said Letters Patent are hereby corrected as shown below:

Column 1, line 16, "uses" should read ---used---.

Column 7, line 54, "formed" should read ---foamed---.

Column 10, line 68, "MCT ECT" should read ---MCT ≤ ECT---.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*